US006814600B2

(12) United States Patent
Rüter

(10) Patent No.: US 6,814,600 B2
(45) Date of Patent: Nov. 9, 2004

(54) HERMAPHRODITIC CONTACT PART

(75) Inventor: Andreas Rüter, Rahden (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 10/447,935

(22) Filed: May 29, 2003

(65) Prior Publication Data

US 2003/0232542 A1 Dec. 18, 2003

(30) Foreign Application Priority Data

Jun. 13, 2002 (DE) ..... 102 26 279

(51) Int. Cl.[7] ..... H01R 13/28; H01R 25/00
(52) U.S. Cl. ..... 439/290
(58) Field of Search ..... 439/290, 291, 439/293, 284, 851, 289

(56) References Cited

U.S. PATENT DOCUMENTS

| | | | | |
|---|---|---|---|---|
| 4,061,406 A | 12/1977 | Kunkle | 439/291 |
| 4,695,110 A | 9/1987 | Wasserlein | 439/289 |
| 5,183,409 A | 2/1993 | Clever et al. | 439/291 |
| 5,577,928 A | 11/1996 | Duclos | 439/290 |
| 6,193,537 B1 | 2/2001 | Harper, Jr. et al. | 439/291 |

FOREIGN PATENT DOCUMENTS

| | | |
|---|---|---|
| CH | 30514 | 3/1904 |
| DE | 1177231 | 5/1962 |
| DE | 1947356 | 9/1969 |
| DE | 2538395 | 8/1975 |
| EP | 0681345 | 4/1995 |
| EP | 0681345 B1 | 4/1995 |
| GB | 968814 | 5/1963 |

*Primary Examiner*—Javaid H. Nasri
(74) *Attorney, Agent, or Firm*—Hayes Soloway P.C.

(57) ABSTRACT

For an electric hermaphroditic plug-in connector a hermaphroditic contact with a plug-in area and a terminal area is proposed that consists of a solid, single-piece contact part, the plug-in area being formed as an adjacent sleeve and pin contact and a separate, elastic contact element being provided in the sleeve contact.

2 Claims, 4 Drawing Sheets

HERMAPHRODITIC CONTACT PART

Figure 1:
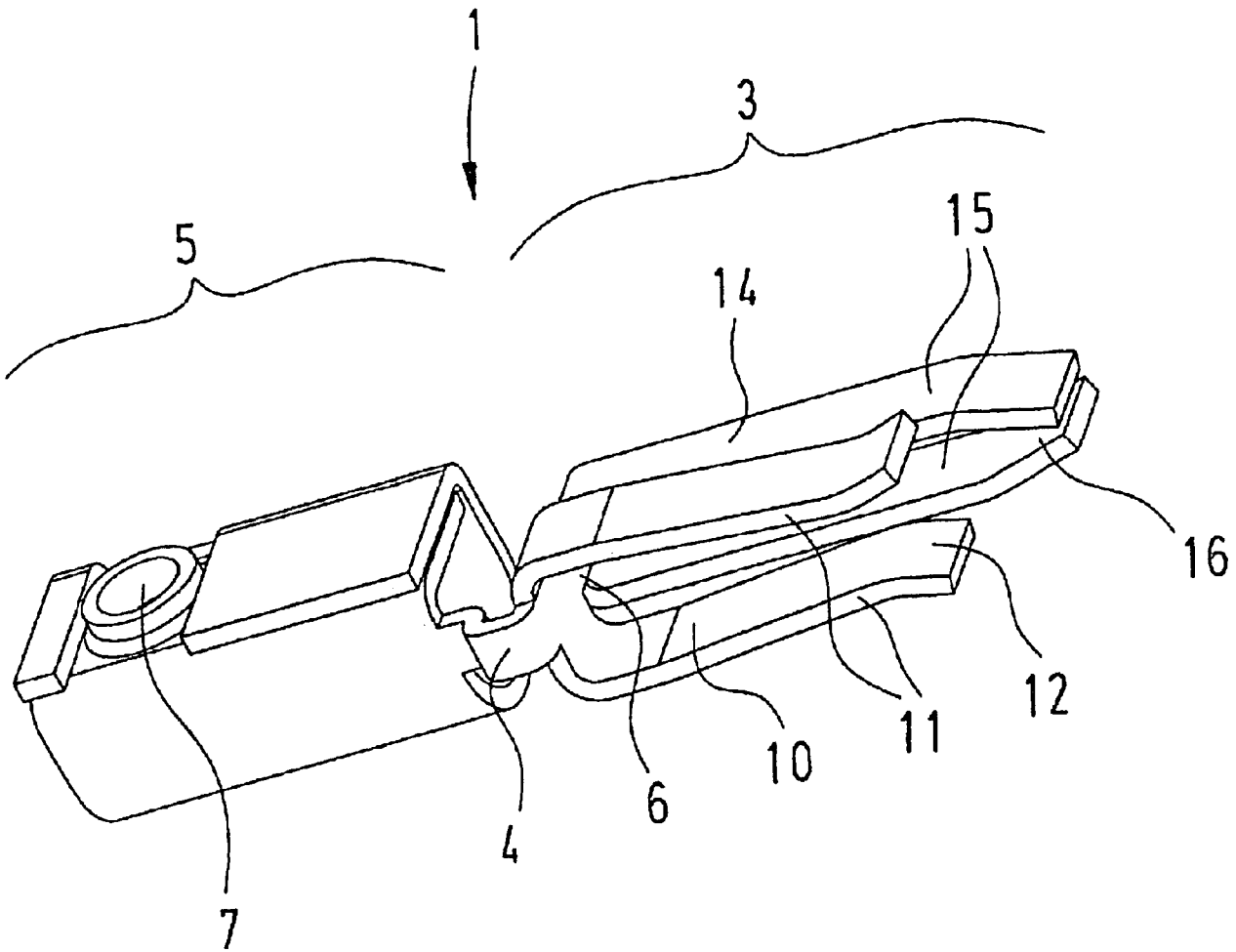
Prior Art Fig. 1

The invention relates to a single-piece, electric hermaphroditic contact part with a plug-in area and a terminal area for a hermaphroditic plug-in connector, the contact part having a plug-in area with a sleeve contact and a pin contact that are arranged directly adjacent to one another.

An electric hermaphroditic contact part of this kind is required to facilitate unmistakable plugging when connecting electric conductors for the transmission of high current-carrying capacity.

A reversible plug-in device is known from Swiss patent specification 30 514 that describes a coupling for electric lines with identical coupling halves, in which the free end of the contact points consists of a pin of semicircular cross-section and a sheath of sickle-shaped cross-section, the hollow side of which faces the flat side of the pin, so that when coupled together the pins of the coupling half always come to lie in the sheath of the other coupling half.

A hermaphroditic multiple plug is known from U.S. Pat. No. 5,183,409 in which two identical, round plug pins respectively have two axially formed fingers that are separated by a central slot, the plug pins being pluggable into one another with an exact fit with a 90° rotation.

Finally, U.S. Pat. No. 6,193,537 describes a hermaphroditic contact that has two tongues arranged adjacent to one another, one of which is executed flat and the second elastically. When the contacts, which are offset in relation to one another by 180°, are plugged together, a flat tongue meets an elastically designed tongue respectively.

The object of the invention therefore is to develop a hermaphroditic contact part of the type specified at the beginning, in which the contact part has a plug-in contact with a sleeve and a pin, to the extent that the contact part is suitable for the transmission of high current-carrying capacity, yet can be used at the same time in known and existing plug systems.

This object is achieved in that the contact part is manufactured from solid material, the sleeve contact having a pincer-shaped receptacle with an expanded recess, into which an U-shaped, elastic contact element provided with a tulip-shaped plug-in area is inserted.

An advantageous configuration of the invention is indicated in claim 2.

The advantages achieved with the invention consist in particular in the fact that such an electric hermaphroditically formed contact can be used unmistakably as a reversibly pluggable contact together with a correspondingly formed plug casing.

In addition, such a contact has the advantage that only one component has to be kept in stock.

A solidly formed contact element is provided in which the sleeve contact is formed pincer-shaped, into which only an elastic contact element with a tulip-shaped plug-in area is inserted. Furthermore, it is advantageous that this contact with a correspondingly formed plug casing is insertable in existing casing designs and is thus exchangeable, the improved electrical properties due to the double contacting also facilitating a high current load through the double pin and sleeve contacts.

An embodiment of the invention is shown in the drawing and is explained in greater detail below.

Figure 2A:
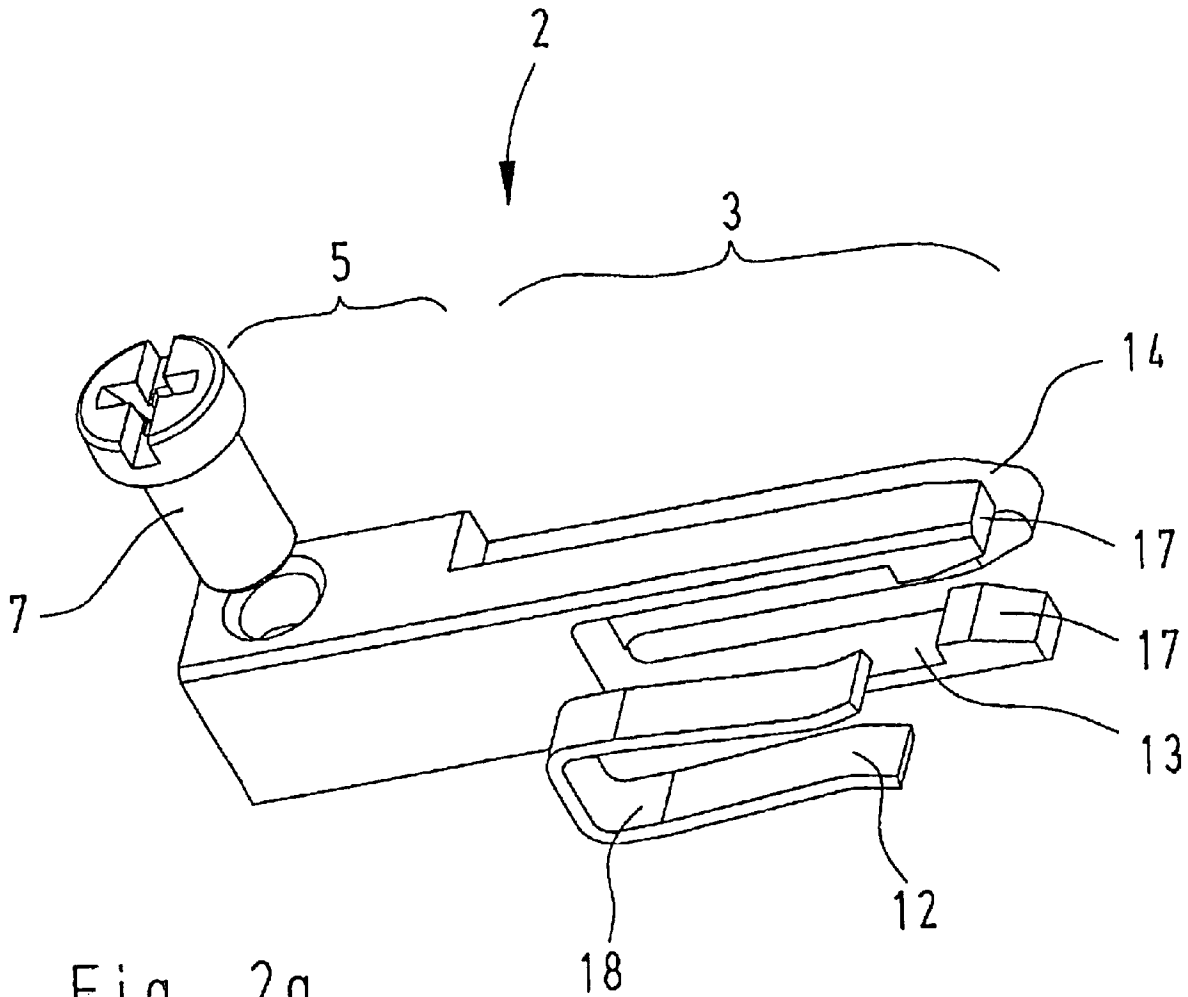
Figure 2B:
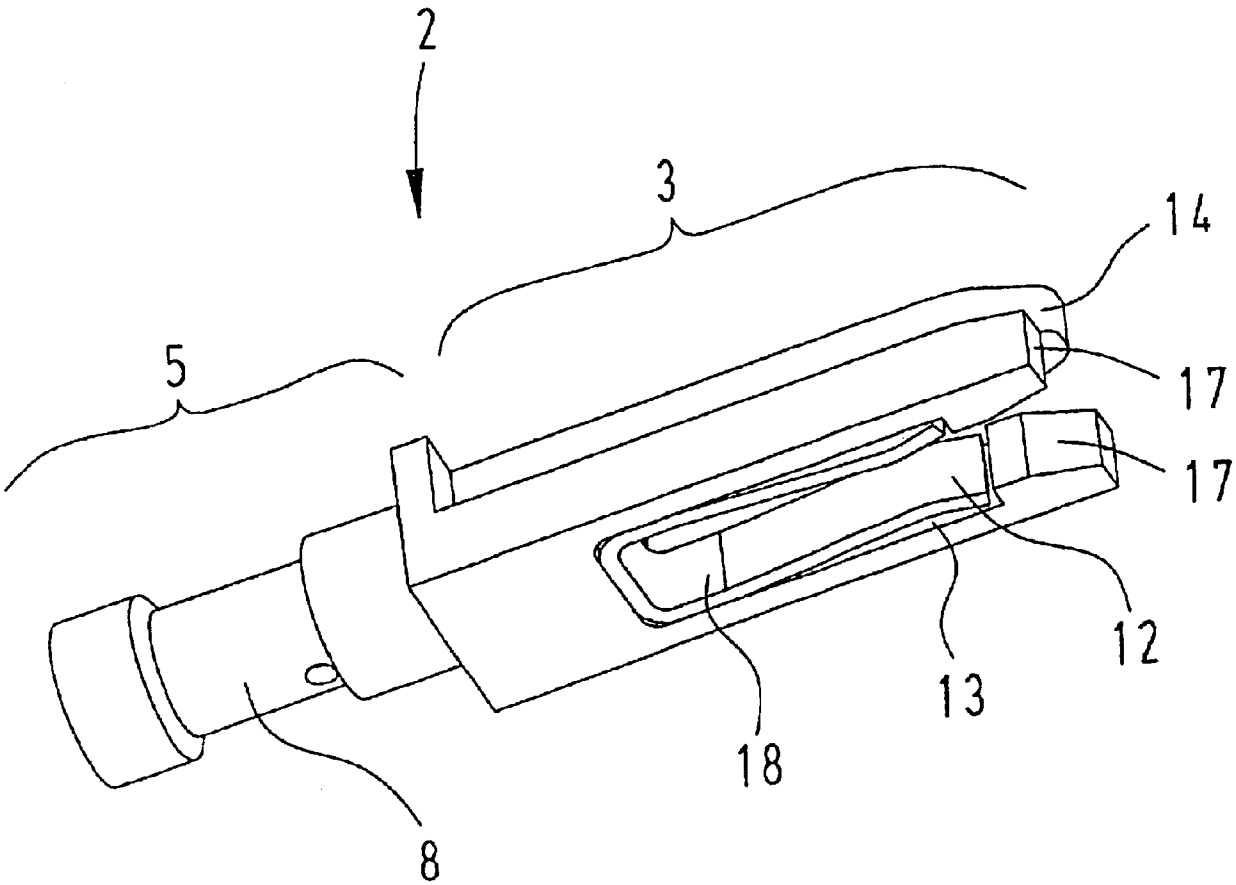
Figure 3:
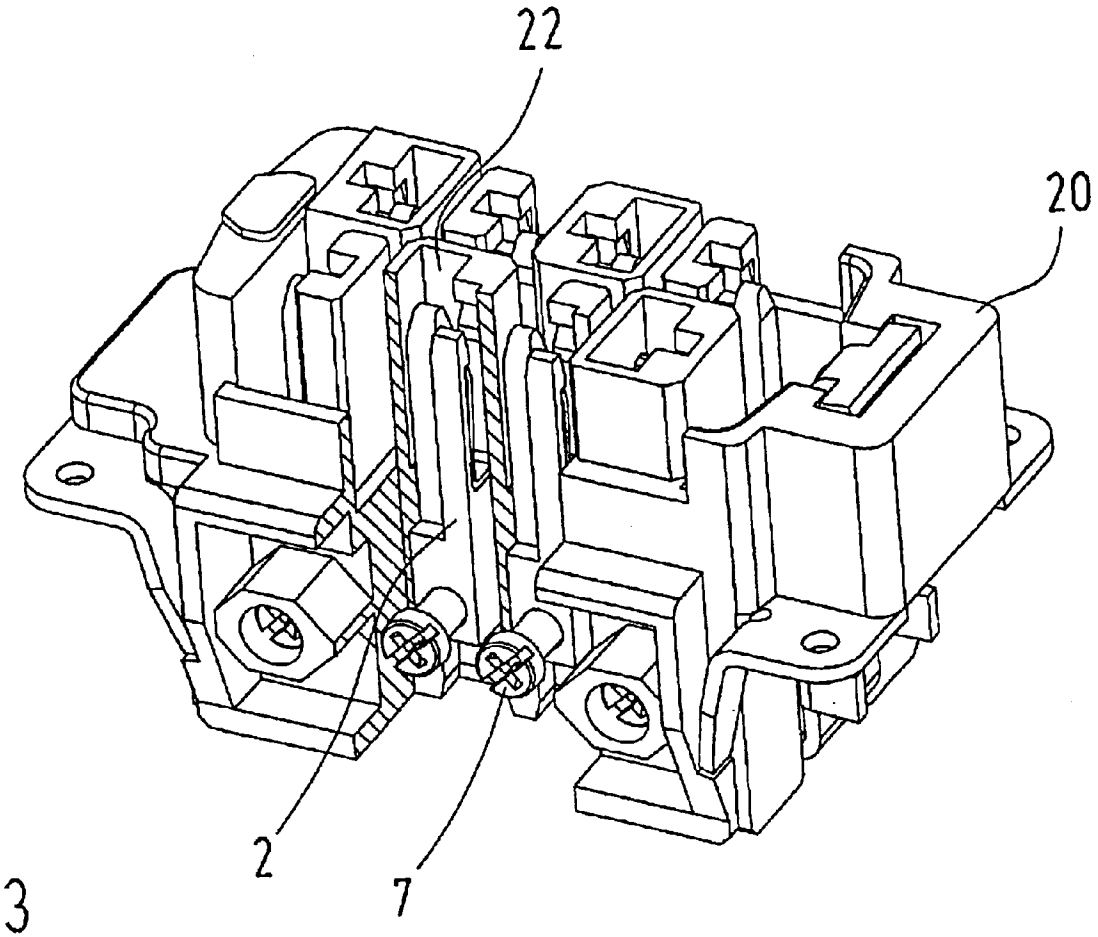

FIG. 1 shows a hermaphroditic punched and bent contact known from the prior art, FIG. 2*a* shows a hermaphroditic contact manufactured from solid material, FIG. 2*b* shows a solid hermaphroditic contact with contact element inserted, and FIG. 3 shows an execution of a hermaphroditic contact in a plug-in connector casing.

In FIG. 1, a hermaphroditic contact part 1 formed as a single-piece punched and bent part from sheet metal material is shown, with a plug-in area 3 and a terminal area 5, as known from the prior art.

The terminal area 5 is bent as a sheath and provided with a screw terminal 7, so that an electric conductor inserted in the sheath is fixed by means of the screw terminal. However, the terminal area can also be executed as an open crimp zone.

The plug-in area 3 consists of a sleeve contact 10, formed from flat limbs 11, which has a tulip-shaped plug-in area 12 and a pin contact 14 likewise formed from flat limbs 15, the plug-in ends 16 of which are bent inwards. Sleeve and pin contact, connected by a web 6, are arranged adjacent to one another in this case and connected in turn to the terminal area by means of a web 4.

The terminal area and plug-in area are arranged axially behind one another, the cross-sectional dimensions of the plug-in area not exceeding those of the terminal area.

FIG. 2*a* shows a cast or machined solid hermaphroditic contact part 2 with a plug-in area 3 and a terminal area 5.

The terminal area for an electric conductor is likewise executed as a screw terminal 7 in this example, but can also be provided with a crimp connection, plug-in connection or a cage clamp spring connection.

The plug-in area 3 has three finger-like mouldings in all, two mouldings forming a pincer-shaped sleeve contact 17, in which a recess 13 is provided, into which a U-shaped, elastically formed contact element 18 provided with a tulip-shaped plug-in area 12 is insertable, while the third moulding forms the pin contact 14.

In FIG. 2*b*, a complete hermaphroditic contact part 2 is shown, in which the contact element 18 is positioned inside the recess 13 of the sleeve contact, the terminal area 5 here being executed as a solder or crimp connection 8.

An isometric representation of a complete hermaphroditic plug-in connector is shown in FIG. 3.

Here two of the hermaphroditic contact parts 2 with screw terminals 7 are inserted into partly cut-open chambers 22 of a plug-in connector casing 20 made of insulating material.

What is claimed is:

1. Single-piece, electric hermaphroditic contact part with a plug-in area and a terminal area for a hermaphroditic plug-in connector, the contact part having a plug-in area with a sleeve contact and a pin contact that are arranged directly adjacent to one another, characterized in that the contact part is manufactured from solid material, the sleeve contact having a pincer-shaped receptacle with an expanded recess, into which a U-shaped, elastic contact element provided with a tulip-shaped plug-in area is inserted.

2. Hermaphroditic contact part according to claim 1, characterized in that the terminal area is executed as a screw fastener, crimp connection, plug-in connection or as a cage clamp screw connection.

* * * * *